US009273404B2

(12) United States Patent
Bulan et al.

(10) Patent No.: US 9,273,404 B2
(45) **Date of Patent: *Mar. 1, 2016**

(54) PROCESS FOR ELECTROLYSIS OF ALKALI METAL CHLORIDES WITH OXYGEN-CONSUMING ELECTRODES

(71) Applicant: BAYER INTELLECTUAL PROPERTY GMBH, Monheim (DE)

(72) Inventors: Andreas Bulan, Langenfeld (DE); Rainer Weber, Odenthal (DE); Jürgen Kintrup, Leverkusen (DE)

(73) Assignee: Bayer Intellectual Property GmbH, Monheim (DE)

( * ) Notice: Subject to any disclaimer, the term of this patent is extended or adjusted under 35 U.S.C. 154(b) by 56 days.

This patent is subject to a terminal disclaimer.

(21) Appl. No.: 13/772,501

(22) Filed: Feb. 21, 2013

(65) Prior Publication Data

US 2013/0240370 A1 Sep. 19, 2013

(30) Foreign Application Priority Data

Mar. 15, 2012 (DE) ..... 10 2012 204 040

(51) Int. Cl.

| | |
|---|---|
| ***C25B 1/46*** | (2006.01) |
| ***C25B 9/08*** | (2006.01) |
| ***C25B 15/02*** | (2006.01) |

(52) U.S. Cl.

CPC ... *C25B 1/46* (2013.01); *C25B 9/08* (2013.01); *C25B 15/02* (2013.01)

(58) Field of Classification Search

USPC ..... 205/516, 537

See application file for complete search history.

(56) References Cited

U.S. PATENT DOCUMENTS

| | | | | |
|---|---|---|---|---|
| 4,364,806 | A | 12/1982 | Rogers | |
| 4,578,159 | A | 3/1986 | Miles et al. | |
| 4,627,897 | A * | 12/1986 | Tetzlaff et al. | 205/620 |
| 2008/0116063 | A1 * | 5/2008 | Yamada et al. | 204/284 |
| 2009/0071820 | A1 * | 3/2009 | Saiki et al. | 204/252 |

FOREIGN PATENT DOCUMENTS

| | | | |
|---|---|---|---|
| JP | 2004-300510 | A | 10/2004 |
| WO | 01/57290 | A1 | 8/2001 |
| WO | 2008/009661 | A2 | 1/2008 |

* cited by examiner

*Primary Examiner* — Arun S Phasge

(74) *Attorney, Agent, or Firm* — Norris McLaughlin & Marcus PA

(57) ABSTRACT

Processes for electrolysis of alkali metal chlorides with oxygen-consuming electrodes having startup and shutdown conditions which prevent damage to the constituents of the electrolysis cell.

13 Claims, No Drawings

PROCESS FOR ELECTROLYSIS OF ALKALI METAL CHLORIDES WITH OXYGEN-CONSUMING ELECTRODES

The invention relates to a process for electrolysis of aqueous solutions of alkali metal chlorides using oxygen-consuming electrodes under specific operating conditions.

BACKGROUND OF THE INVENTION

The invention proceeds from electrolysis processes known per se for electrolysis of aqueous alkali metal chloride solutions using oxygen-consuming electrodes in the form of gas diffusion electrodes which typically comprise an electrically conductive carrier and a gas diffusion layer comprising a catalytically active component.

Various proposals for operation of the oxygen-consuming electrodes in electrolysis cells on the industrial scale are known in principle from the prior art. The basic idea is to replace the hydrogen-evolving cathode in the electrolysis (for example in chloralkali electrolysis) with the oxygen-consuming electrode (cathode). An overview of the possible cell designs and solutions can be found in the publication by Moussallem et al "Chlor-Alkali Electrolysis with Oxygen Depolarized Cathodes: History, Present Status and Future Prospects", J. Appl. Electrochem. 38 (2008) 1177-1194.

The oxygen-consuming electrode—also called OCE for short hereinafter—has to meet a series of requirements to be usable in industrial electrolyzers. For instance, the catalyst and all other materials used have to be chemically stable against concentrated alkali metal hydroxide solutions and towards pure oxygen at a temperature of typically 80-90° C. Similarly, a high degree of mechanical stability is required, such that the electrodes can be installed and operated in electrolyzers with a size typically more than 2 $m^2$ in area (industrial scale). Further desirable properties are: high electrical conductivity, low layer thickness, high internal surface area and high electrochemical activity of the electrocatalyst. Suitable hydrophobic and hydrophilic pores and a corresponding pore structure for transmission of gas and electrolyte are likewise necessary, as is such imperviosity that gas and liquid space remain separate from one another. Long-term stability and low production costs are further particular requirements on an industrially usable oxygen-consuming electrode.

A problem in the case of arrangement of an OCE in a cathode element arises from the fact that, on the catholyte side, the hydrostatic pressure forms a gradient over the height of the electrode, which is opposed on the gas side by a constant pressure over the height. The effect of this can be that, in the lower region of the electrode, the hydrophobic pores too are flooded and liquid gets onto the gas side. On the other hand, in the case of excessively high gas pressure in the upper part of the OCE, liquid can be displaced from the hydrophilic pores and oxygen can get onto the catholyte side. Both effects reduce the performance of the OCE. In practice, the effect of this is that the construction height of an OCE is limited to about 30 cm unless further measures are taken.

A preferred solution to this problem results from an arrangement in which the catholyte is conducted from the top downward through a flat porous element mounted between OCE and ion exchange membrane, called a percolator, in a kind of free-falling liquid film, called falling film for short, along the OCE. In this arrangement, no liquid column bears on the liquid side of the OCE, and no hydrostatic pressure profile builds up over the construction height of the cell. A description of this arrangement can be found in WO 2001/57290 A1.

In another version, the ion exchange membrane which, in the electrolysis cell, divides the anode space from the cathode space, without an intervening space for the flow of an alkali, called catholyte gap for short, directly adjoins the OCE. This arrangement is also referred to as the "zero gap" arrangement, as opposed to a "finite gap" arrangement in which the alkali metal hydroxide solution is conducted through a defined narrow gap between OCE and the membrane. The zero gap arrangement is typically also employed in fuel cell technology. A disadvantage here is that the alkali metal hydroxide solution which forms has to be passed through the OCE to the gas side and then flows downwards at the OCE. In the course of this, the pores in the OCE must not be blocked by the alkali metal hydroxide, and there must not be any crystallization of alkali metal hydroxide in the pores. It has been found that a very high alkali metal hydroxide concentration can indeed arise here too, but it is stated that the ion exchange membrane at these high concentrations lacks long-term stability (Lipp et al., J. Appl. Electrochem. 35 (2005)1015—Los Alamos National Laboratory "Peroxide formation during chlor-alkali electrolysis with carbon-based ODC").

An oxygen-consuming electrode consists typically of a support element, for example a plate of porous metal or a metal wire mesh, and an electrochemically catalytically active coating. The electrochemically active coating is microporous and consists of hydrophilic and hydrophobic constituents. The hydrophobic constituents make it difficult for electrolytes to penetrate through and thus keep the corresponding pores in the OCE unblocked for the transport of the oxygen to the catalytically active sites. The hydrophilic constituents enable the electrolyte to penetrate to the catalytically active sites, and the hydroxide ions to be transported away from the OCE. The hydrophobic component used is generally a fluorinated polymer such as polytetrafluoroethylene (PTFE), which additionally serves as a polymeric binder for particles of the catalyst. In the case of electrodes with a silver catalyst, for example, the silver serves as a hydrophilic component.

A multitude of compounds have been described as electrochemical catalysts for the reduction of oxygen. However, only platinum and silver have gained practical significance as catalysts for the reduction of oxygen in alkaline solutions.

Platinum has a very high catalytic activity for the reduction of oxygen. Due to the high costs of platinum, it is used exclusively in supported form. A preferred support material is carbon. However, stability of carbon-supported and platinum-based electrodes in long-term operation is inadequate, probably because platinum also catalyses the oxidation of the support material. Carbon additionally promotes the unwanted formation of $H_2O_2$, which likewise causes oxidation. Silver likewise has a high electrocatalytic activity for the reduction of oxygen.

Silver can be used in carbon-supported form, and also as fine metallic silver. Even though the carbon-supported silver catalysts are more durable than the corresponding platinum catalysts, the long-term stability thereof under the conditions in oxygen-consuming electrodes, especially in the case of use for chloralkali electrolysis, is limited.

In the case of production of OCEs comprising unsupported silver catalyst, the silver is preferably introduced at least partly in the form of silver oxides, which are then reduced to metallic silver. The reduction is generally effected when the electrolysis cell is first started up. The reduction of the silver compounds also results in a change in the arrangement of the crystals, more particularly also to bridge formation between individual silver particles. This leads to overall consolidation of the structure.

It has been observed that, when the electrolysis current is switched off, the silver catalyst can be oxidized again. The oxidation is apparently promoted by the oxygen and the moisture in the half-cell. The oxidation can result in rearrangements in the catalyst structure, which have adverse effects on the activity of the catalyst and hence on the performance of the OCE.

It has also been found that the performance, especially the electrolysis voltage required, in an OCE with a silver catalyst depends considerably on the startup conditions. This applies both to the first startup of an OCE and to the further startups after a shutdown. It is one of the objects of the present invention to find specific conditions for the operation and especially the startup of an OCE with a silver catalyst, which ensure a high performance of the OCE.

A further central element of the electrolysis cell is the ion exchange membrane. The membrane is pervious to cations and water and substantially impervious to anions. The ion exchange membranes in electrolysis cells are subject to severe stress: They have to be stable towards chlorine on the anode side and to severe alkaline stress on the cathode side at a temperature around 90° C. Perfluorinated polymers such as PTFE typically withstand these stresses. The ions are transported via sulphonate groups or carboxyl groups polymerized into these polymers. Carboxyl groups exhibit higher selectivity, have lower water absorption and have higher electrical resistance than sulphonate groups. In general, multilayer membranes are used, with a thicker layer containing sulphonate groups on the anode side and a thinner layer containing carboxyl groups on the cathode side. The membranes are provided with a hydrophilic layer on the cathode side or both sides. To improve their mechanical properties, the membranes are reinforced by the inlaying of wovens or knits; the reinforcement is preferably incorporated into the layer containing sulphonate groups.

Due to the complex structure, the ion exchange membranes are sensitive to changes in the media surrounding them. Different molar concentrations can result in formation of significant osmotic pressure gradients between the anode and cathode sides. When the electrolyte concentrations decrease, the membrane swells as a result of increased water absorption. When the electrolyte concentrations increase, the membrane releases water and shrinks as a result; in the extreme case, withdrawal of water can cause precipitation of solids in the membrane or mechanical destruction of the membrane.

Concentration changes can thus cause disruption and damage at the membrane. The result may be delamination of the layer structure (blister formation), as a result of which the mass transfer through the membrane deteriorates.

In addition, pinholes and, in the extreme case, cracks can occur, which can result in mixing of anolyte and catholyte.

In production plants, it is desirable for electrolysis cells to be operated over periods of up to several years, without opening them in the meantime. Due to variation in demand volumes and faults in production sectors upstream and downstream of the electrolysis, electrolysis cells in production plants, however, inevitably have to be repeatedly switched off and back on again.

On shutdown and restart of the electrolysis cells, there occur conditions which can lead to damage to the cell elements and considerably reduce the lifetime thereof. More particularly, oxidative damage has been found in the cathode space, as have damage to the OCE and damage to the membrane.

The prior art discloses few modes of operation with which the risk of damage to the electrolysis cells in the course of startup and shutdown can be reduced.

A measure known from conventional membrane electrolysis is the maintenance of a polarization voltage, which means that, when the electrolysis is ended, the potential difference is not run down to zero, but maintained at the level of the polarization voltage. In practical terms, a somewhat higher voltage than that required for the polarization is set, such that a constant low current flows and electrolysis proceeds to a minor degree. However, in the case of use of OCEs, this measure is insufficient to prevent oxidative damage to OCEs which have been shut down.

Published specification JP 2004-300510 A describes an electrolysis process using a micro-gap arrangement, in which corrosion in the cathode space is to be prevented by flooding the gas space with sodium hydroxide solution on shutdown of the cell. The flooding of the gas space with sodium hydroxide solution accordingly protects the cathode space from corrosion, but gives inadequate protection from damage to the electrode and the membrane on shutdown and startup, or during shutdown periods.

U.S. Pat. No. 4,578,159A1 states that, for an electrolysis process using a zero gap arrangement, purging the cathode space with 35% sodium hydroxide solution prior to startup of the cell, or starting up the cell with low current density and gradually increasing the current density, prevents damage to membrane and electrode. This procedure reduces the risk of damage to membrane and OCE during startup, but does not give any protection from damage during shutdown and shutdown periods.

Document U.S. Pat. No. 4,364,806A1 discloses that exchange of the oxygen for nitrogen after downregulating the electrolysis current will prevent corrosion in the cathode space. According to WO2008009661A2, the addition of a small proportion of hydrogen to the nitrogen will give rise to an improvement in protection from corrosion damage. The methods mentioned, however, are complex and entail the installation of additional equipment for nitrogen and hydrogen supply. Moreover, the addition of hydrogen increases the safety risk in the course of operation of such electrolysers through formation of explosive gas mixtures, since residues of oxygen may be present in the cathode space. On restart, the pores of the OCE are partly filled with nitrogen, which prevents the supply of oxygen to the reactive sites. The process also does not give any protection from damage to the ion exchange membrane.

The Final Technical Report "Advanced Chlor-Alkali Technology" by Jerzy Chlistunoff (Los Alamos National Laboratory, DOE Award 03EE-2F/Ed190403, 2004) details conditions for the temporary shutdown and startup of zero gap cells. In the case of shutdown, after the electrolysis current has been stopped, the oxygen supply is stopped and replaced by nitrogen. The moistening of the gas stream is increased in order to wash out the remaining NaOH. On the anode side, the brine is replaced by hot water (90° C.). The procedure is repeated until a stable polarization voltage (open-circuit voltage) has been attained. The cells are then cooled, then the supply of moist nitrogen and the pumped circulation of the water on the anode side are stopped.

For the restart, the anode side is first filled with brine; on the cathode side, water and nitrogen are introduced. The cell is then heated to 80° C. Then the gas supply is switched to oxygen and a polarization voltage with low current flow is applied. Subsequently, the current density is increased and the pressure in the cathode is increased; the temperature rises to 90° C. Brine and water supply are subsequently adjusted such that the desired concentrations on the anode and cathode sides are attained.

The known processes described are complex to conduct; this is especially true of industrial electrolysis plants, where safety aspects are of increased importance. Moreover, not all processes can be applied to electrolysis cells with a finite gap arrangement.

It should be stated that the techniques described to date for startup and shutdown of an OCE are disadvantageous and give only inadequate protection from damage.

It is an object of the present invention to provide an improved electrolysis process for chloralkali electrolysis using an OCE in the finite gap arrangement with suitable operating parameters for startup and shutdown of the electrolysis cell having an OCE with a silver catalyst as the electrocatalytic substance, which are simple to perform and where compliance prevents damage to membrane, electrode and/or other components of the electrolysis cell.

SUMMARY OF THE INVENTION

The object is achieved by, on startup of an electrolysis cell in the finite gap arrangement having an OCE with a silver catalyst on the cathode side, initially charging an aqueous alkali metal hydroxide solution having low contamination with chloride—and possibly of other anions—and by filling the anode space with brine only after startup of the catholyte circulation; and by, independently of this, on shutdown of an electrolysis cell, after switching off the electrolysis voltage, in a first step, concentrating the anolyte, then cooling it and then releasing it, and, in a subsequent step, releasing the catholyte.

DETAILED DESCRIPTION

The invention provides a process for chloralkali electrolysis with an electrolysis cell having an oxygen-consuming electrode, preferably operated according to the principle of the finite gap arrangement, especially preferably according to the principle of a falling-film cell, the electrolysis cell having at least one anode space with an anode and an anolyte comprising alkali metal chloride, an ion exchange membrane, a cathode space with an oxygen-consuming electrode as the cathode, comprising a silver-containing catalyst, and an electrolyte gap between oxygen-consuming electrode and membrane through which the catholyte flows, wherein application of the electrolysis voltage between anode and cathode is preceded by adjustment of the volume flow rate and/or composition of the catholyte supplied to the gap such that the aqueous solution of alkali metal hydroxide leaving the cathode gap has a content of chloride ions of at most 1000 ppm, preferably at most 700 ppm, more preferably at most 500 ppm, and the electrolysis voltage is applied after introduction of the anolyte and of an oxygenous gas into the cathode space.

"Finite gap arrangement" in the context of the invention means any arrangement of an electrolysis cell which has an electrolyte gap between oxygen-consuming electrode and membrane through which the catholyte flows, the gap having a gap width of at least 0.1 mm and especially a gap width of at most 5 mm. In the electrolysis cell according to the principle of the falling-film cell, which is used with preference, catholyte flows from the top downwards, following gravity, in a vertically arranged electrolysis cell. Other arrangements with alternative flow direction or a horizontally arranged electrolysis cell shall also be encompassed by the invention.

The invention further provides a process for chloralkali electrolysis with an electrolysis cell having an oxygen-consuming electrode, preferably operated according to the finite gap principle, for example a falling-film cell, the cell having at least one anode space with an anode and an anolyte comprising alkali metal chloride, an ion exchange membrane, a cathode space with an oxygen-consuming electrode with a silver-containing catalyst, and an electrolyte gap between oxygen-consuming electrode and membrane through which the catholyte flows, wherein, at the end of the electrolysis operation, after the electrolysis voltage has been switched off, in a first step, the concentration of the alkali metal chloride solution removed from the anode space increases, then the anode space is flushed with fresh alkali metal chloride solution until the chlorine content of oxidation state 0 or greater than 0 in the anolyte is especially less than 10 ppm, then the anolyte temperature is lowered and then the anolyte is released from the anode space and, in a subsequent step, the supply of the catholyte is ended and the catholyte is released from the electrolyte gap.

These two variants of the electrolysis process are, in a preferred embodiment, combined with one another, such that both the conditions described for the startup of the electrolysis and for the shutdown are complied with. This also includes the preferred variants described hereinafter.

In the cathode, strongly oxidative conditions exist as a result of the oxygen, and these can no longer be compensated for by the electrolysis current on shutdown. After the electrolysis current has been switched off, moreover, chloride ions diffuse to an increased extent through the membrane into the cathode space. Chloride ions promote corrosion processes; in addition, oxidation of the silver catalyst can form insoluble silver chloride. There is the risk of damage to the electrode and also to the entire cathode space.

When the electrolysis voltage is switched off, the mass transfer through the membrane caused by the current flow also stops; in addition, unwanted changes in the concentration of the brine and the alkali metal hydroxide solution can also occur. The membrane becomes deficient in water; there may be shrinkage and precipitation of solids and subsequently pinhole formation; the passage of anions through the membrane is facilitated. On restart, in turn, an excessively low water content hinders mass transfer through the membrane, as a result of which there may be an increase in the osmotic pressure and delamination at the interfaces between the layers containing sulphonic acid groups and layers containing carboxylic acid groups which are typically used in such membranes.

Inhomogeneity of the water and/or ion distribution in the membrane and/or the OCE can, on restart, lead to local spikes in the current and mass transfer, and subsequently to damage to the membrane or the OCE.

Problems are also presented by the precipitation of alkali metal chloride salts on the anode side. The significant osmotic gradient between anolyte and catholyte results in water transport from the anode space to the cathode space. As long as the electrolysis is in operation, the water transport out of the anode space is countered by a loss of chloride and alkali metal ions, such that the concentration of alkali metal chloride falls in the anode space under standard electrolysis conditions. When the electrolysis is switched off, the water transport from the anode space into the cathode space caused by the osmotic pressure remains. The concentration in the anolyte rises above the saturation limit. The result is precipitation of alkali metal chloride salts, especially in the boundary region to the membrane or even in the membrane, which can lead to damage to the membrane.

With the provision of the novel electrolysis processes according to the invention, the aforementioned problems and disadvantages of the processes known to date are overcome.

This is because it has been found that, surprisingly, electrolysers comprising an OCE with a silver catalyst, through the sequence of these comparatively simpler steps, can repeatedly be put into and out of operation without damage, and do not incur any damage even in shutdown periods. The process is especially suitable for the electrolysis of aqueous sodium chloride and potassium chloride solutions.

The operating parameters for the startup and shutdown of an electrolysis cell with an OCE are described hereinafter for an electrolysis cell with an OCE having a silver catalyst and finite gap arrangement, which can be operated as follows: The concentration of the alkali metal chloride solution (anolyte) of 2.9-4.3 mol/l and of an alkali metal hydroxide-concentration (catholyte) of 8.0-12 mol/l is described in detail as a particular embodiment, without wishing to restrict the execution to the procedure thus described. More particularly, for the startup or for the shutdown of such an electrolysis cell, further embodiments may also be used in which, in the course of startup, the contamination of chloride and other anions in the aqueous solution of the alkali metal hydroxide solution draining from the alkali gap does not exceed particular limits and the anode space is not filled with aqueous alkali metal chloride solution until after startup of the catholyte circulation; and in which, in the course of shutdown, the sequence of concentration changes and release of the anolyte and subsequent release of the catholyte is complied with. The startup of an electrolysis unit with finite gap arrangement, an OCE with a silver catalyst and an ion exchange membrane soaked in accordance with the prior art is effected, for example, as follows:

Startup, Catholyte Side

Prior to startup of the catholyte circulation, moistened oxygen is added and a positive pressure corresponding to the configuration in the cell is established in the cathode half-cell, generally of the magnitude of 10-100 mbar relative to the pressure in the anode. The purity of the oxygen corresponds to the concentrations and purity requirements customary in the electrolysis with OCE, preference being given to oxygen with a residual gas content of <10% by volume.

The oxygen can be moistened at room temperature or at the temperature existing in the cell. More particularly, the moistening can be effected at a temperature corresponding to the cell temperature.

The catholyte circulation is put into operation after startup of the oxygen supply. The catholyte (aqueous alkali metal hydroxide solution) can be supplied here, for example, into the cathode gap from the top, flows through the cathode gap, is removed again in the lower region and can partly, after adjusting the concentration by means of a pump, be recycled back into the upper region of the cathode gap. In order to minimize the volume flow rate, a flow limiter, for example a flat porous element, can be installed into the cathode gap. The concentration of the alkali metal hydroxide solution supplied in this step preferably has a concentration kept up to 3.5 mol/l lower than in the later electrolysis; it is preferably 7.5-10.5 mol/l. The concentration of the alkali metal hydroxide solution in the later electrolysis is typically in the range of 8-12 mol/l, preferably 9.5-11.5 mol/l.

The concentration of chloride ions in the catholyte removed is not more than 1000 ppm, preferably <700 ppm, more preferably <500 ppm. In this context, the basis is the abovementioned concentration of alkali metal hydroxide in the catholyte.

The concentration of alkali metal chlorate, especially sodium chlorate, in the catholyte removed is not more than 20 ppm, preferably <15 ppm, more preferably <10 ppm. In this context, the basis is the abovementioned concentration of alkali metal hydroxide in the catholyte.

The concentrations are determined by titration or another analysis method known in principle to those skilled in the art.

For the startup of the catholyte circulation, preference is given to using alkali metal hydroxide solution from regular production. Alkali metal hydroxide solution from shutdown operations is less suitable for startup particularly because of the contamination with chloride ions. The temperature of the catholyte supplied is regulated such that a temperature of 50-95° C., preferably 75-90° C., is established in the output from the cathode space. The temperature of the exiting catholyte can additionally be influenced via the temperature of the anolyte. For instance, by lowering the anolyte feed temperature, the catholyte feed temperature can be increased. Preference is given to establishing a temperature difference between anolyte feed and catholyte drain of less than 20° C.

In a particular embodiment, the novel process is employed in such a way that there are fewer than 240 minutes, preferably fewer than 150 minutes, between commencement of the introduction of the catholyte and the application of the electrolysis voltage. By continuous, partial exchange of the catholyte in the electrolyser circuit, the catholyte circulation without current can be prolonged up to 360 minutes. The exchange keeps the chloride ion concentration low in the alkali metal hydroxide solution leaving the cathode gap.

Anode Side Startup

After startup of the catholyte circulation, the anode space is filled with concentrated aqueous alkali metal chloride solution. The concentration of the alkali metal chloride solution supplied in this step is preferably kept 0.5-1.5 mol/l higher in the later electrolysis; it is preferably 2.9-5.4 mol/l. The concentration of the alkali metal chloride solution supplied in the later electrolysis is typically in the range of 4.8-5.5 mol/l, preferably 5.0-5.4 mol/l. The brine meets the purity requirements customary for membrane electrolyses. After filling the anode space, the brine, according to the usual apparatus conditions, is conducted through the anode space in circulation by pumps. The temperature of the brine in the output from the anode space should be 50-95° C., preferably 70-90° C., before any electrolysis voltage is applied. If the temperature is lower, the anolyte in the circuit is heated.

After filling the anode space and starting up the anode circulation and attaining a temperature of 60-70° C., the electrolysis voltage is applied in the next step. Overall, the total period for the startup should be kept to a minimum. Between startup of the catholyte circuit and anolyte circulation and the switching-on of the electrolysis current, there should be fewer than 240 minutes, preferably fewer than 150 minutes. In industrial electrolysers having an area of, for example, 2.7 $m^2$, the current is preferably increased until attainment of the target current at a rate of 0.05-1 kA/min. The electrolysis cell is then run with the design parameters, for example with a concentration of 2.9 to 4.3 mol of alkali metal chloride per liter in the anode space and a concentration of 8-12 mol of alkali metal hydroxide per liter in the cathode drain, a current density of 3-6 $kA/m^2$ and a 30% to 100% excess of oxygen in the gas supply. The process described is suitable both for the first startup of electrolysis units after the installation of a silver-containing, especially of a silver oxide-containing, OCE and for the startup of electrolysis cells with an OCE after a shutdown.

The shutdown of the electrolysis cell is effected, for example, as follows:

Shutdown—Anode Side

In the process, which includes particular conditions for the shutdown of the electrolysis cell, the reduction in the electrolysis current to a current density of 5-35 $A/m^2$ is followed by an increase in the concentration of the brine flowing out of the anode space to 4.0 to 5.3 mol/l.

In another preferred embodiment of the process, which includes particular conditions for the shutdown of the electrolysis cell, the electrolysis voltage is switched off after attainment of a chlorine content in the anolyte of <10 mg/l, preferably <1 mg/l. Chlorine content is understood here to mean the total content of chlorine in the oxidation state of 0 or higher dissolved in the anolyte.

Particular preference is given to maintaining a positive pressure of the cathode space gas of >10 mbar relative to the anode space gas until the end of the emptying and flushing of the cathode space. This prevents any vibrations in the membrane in operation, which can lead to mechanical stresses and cracks in the membrane.

To achieve freedom from chlorine (not more than 10 ppm Cl of oxidation state 0 or higher) of the anolyte, a brine with an alkali metal chloride content of 4.0 to 5.5 mol/l, preferably 4.3 to 5.4 mol/l, is supplied. The temperature of the concentrated anolyte supplied is guided by the residual chlorine content in the anode space and the electrolysis voltage. At a temperature of less than 70° C., the polarization voltage would rise, such that there is again evolution of chlorine. The temperature of the anolyte supplied is therefore adjusted such that a temperature exceeding 70° C. is established in the drain. After attainment of a chlorine-free state, i.e. <10 ppm of chlorine in the anolyte, and the exchange with concentrated brine, the temperature of the incoming brine is adjusted such that the temperature of the outgoing brine is lowered to 45-55° C., and then the brine is emptied from the anode space. Small residual amounts of concentrated anolyte remain in the anode space.

The polarization voltage can be maintained until the anolyte is released. The polarization voltage is preferably switched off after attainment of a chlorine content in the anode space of ≤10 ppm, more preferably <1 ppm.

Cathode Space Shutdown

After the anode space has been emptied, the catholyte circulation is also stopped and the remaining catholyte is discharged. The cathode gap can also be flushed with dilute aqueous alkali metal hydroxide solution. The concentration of the alkali metal hydroxide solution used for flushing is 2 to 10 mol/l, preferably 4-9 mol/l.

In a further embodiment, the lower third of the catholyte space is flushed. This can be done, for example, by conducting alkali metal hydroxide solution into the cathode space from the bottom and then releasing it again. Small residual amounts of aqueous alkali metal hydroxide solution remain in the cathode gap.

The oxygen supply can be adjusted when the electrolysis voltage is switched off The oxygen supply is preferably adjusted after the cathode space has been emptied, and the oxygen supply can be adjusted before, during or after flushing of the cathode space with alkali metal hydroxide solution. The positive pressure in the cathode space of approx. 10-100 mbar relative to the anode space is maintained during the running-down operation.

Shutdown Period

After emptying anode space and cathode space, the electrolysis cell with the moist membrane can be kept ready for a further startup in the installed state over a prolonged period, without impairing the performance of the electrolysis cell. In the case of shutdown periods extending over several weeks, it is appropriate, for stabilization, to flush the anode space with dilute aqueous alkali metal chloride solution and the cathode space with dilute aqueous alkali metal hydroxide solution at regular intervals.

In another embodiment of the process, which includes particular conditions for the shutdown of the electrolysis cell, after shutdown and emptying of the electrolysis cell, the anode space is flushed repeatedly every 1 to 12 weeks, preferably 4 to 8 weeks, with a dilute alkali metal chloride solution having a content of 2.2 to 4.8 mol/l, and the cathode space with an alkali metal hydroxide solution having a content of 4 to 10 mol/l.

A further embodiment of the process involves flushing the electrode spaces, which are understood to mean the cathode and anode spaces of the electrolysis cell, with moistened gas.

For this purpose, for example, water-saturated nitrogen is introduced into the anode space.

Alternatively, oxygen can also be introduced.

The gas volume will measure such that a 2- to 10-fold volume exchange can be effected. The gas volume flow rate may be 1 l/h to 200 l/h at a temperature of 5 to 40° C., the temperature of the gas preferably being ambient temperature, i.e. 15-25° C. The purge gas is saturated at the temperature of the gas.

The procedure is the same for the cathode space. More preferably, the gas on the cathode side is oxygen.

A further embodiment of the process involves isolating the anode and cathode spaces from the ambient air. The spaces can, for example, be closed after emptying. To compensate for temperature variations in the environment and the associated change in volume, the spaces can also be closed by means of liquid immersion.

The electrolysis cell which has been taken out of operation by the above process is put back into operation by the process described previously. In the case of compliance with the process steps described, the electrolysis cell can pass through a multitude of running-up and -down cycles without any impairment in the performance of the cell.

EXAMPLES

Example 1

A powder mixture consisting of 7% by weight of PTFE powder, 88% by weight of silver(I) oxide and 5% by weight of silver powder was applied to a mesh of nickel wires and pressed to form an oxygen-consuming electrode (OCC). The oxygen-consuming electrode was installed into an electrolysis unit with finite gap arrangement. At the same time, the sodium hydroxide solution is supplied to the gap between membrane (ion exchange membrane: N2030 type, manufacturer: DuPont) and OCE, the gap containing a porous fabric. The electrolysis unit has, in the assembly, an anode space with anolyte feed and drain, with an anode made from coated titanium (mixed ruthenium oxide iridium oxide coating), a cathode space with the OCE as the cathode, and with a gas space for the oxygen and oxygen inlets and outlets, a liquid drain and an inlet and outlet for the sodium hydroxide solution in the gap, and an ion exchange membrane, which are arranged between anode space and cathode space. The gap was approx. 1 mm. The anode was a titanium anode from Uhde, which had said coating. The sodium hydroxide solution volume flow rate was approx. 110 l/h per square meter of geometric cathode area. At the bottom, the sodium hydroxide solution is passed out of the gap into the gas space and before there via a drain tube out of the cathode space.

Before startup of the catholyte circulation, water-saturated oxygen was supplied to the cathode space at room temperature, such that a positive pressure relative to the anode space of 40 mbar was established in the cathode space.

The amount of oxygen was controlled such that a 1.5-fold stoichiometric excess relative to the amount of oxygen required on the basis of the current established is always supplied.

Thereafter, the cathode circuit was put into operation with a 30% by weight sodium hydroxide solution at approx. 50° C.

In the next step, the anode space was filled with brine having a concentration of 230 to 300 g NaCl/l at 50°, and the anode circuit was put into operation. While the anode circulation was maintained, the heating of the anolyte in a heat exchanger incorporated within the anode circuit was commenced.

The sodium hydroxide solution leaving the gap between the membrane and OCE had a content of chloride ions of 320 ppm and a content of sodium chlorate of <10 ppm.

Immediately after attainment of the temperature of the draining anolyte of 70° C. and of the draining catholyte of 70° C., the electrolysis voltage was applied. The electrolysis current was controlled such that an electrolysis current of 1 kA/m$^2$ was attained after 6 minutes, and an electrolysis current of 4 kA/m$^2$ after 30 minutes. The cell voltage at 4 kA/m$^2$ was 2.1 V, the temperature of the draining electrolyte approx. 88° C.

After startup, the concentrations were controlled such that the concentration of the draining brine was approx. 230 g/l and that of the sodium hydroxide solution approx. 31.5% by weight.

Example 2

The electrolysis unit according to Example 1, after a run time of 10 days, was put out of operation as follows:

The electrolysis current was downregulated to 18 A/m$^2$.

Operation of the anolyte circuit continued, with continuous supply of chlorine-free brine having the concentration of 300 g/l. Within this time, the anolyte cooled to 75° C. After attainment of a chlorine content of <1 mg/l in the draining anolyte, the electrolysis current was switched off Thereafter, the anolyte was cooled further, diluted at the same time to a concentration of 250-270 g/l for addition of water and released at a temperature of 50° C.

After releasing the anolyte, the oxygen supply was stopped and the catholyte supply was shut down and the catholyte was released.

48 h after the shutdown, the electrolysis unit was put back into operation as follows:

First, water-saturated oxygen (99.9% by volume) was supplied at room temperature to the cathode space, and this was used to establish a positive pressure of 40 mbar relative to the anode space. In the first step, the cathode circuit was filled with a 30% sodium hydroxide solution at 50° C., having a content of chloride ions of 20 ppm and a content of sodium chlorate of <10 ppm.

In the next step, the anode space was filled with brine having a concentration of 250 g NaCl/l at 50° C., and the anode circuit was put into operation. Immediately after further heating of the electrolyte and attainment of a temperature of the electrolyte (anolyte and catholyte) in the drain of approx. 70° C., the electrolysis voltage was applied. The electrolysis current was controlled such that there was an electrolysis current of 1 kA/m$^2$ after 10 minutes, and an electrolysis current of 4 kA/m$^2$ after 90 minutes. The concentration of the sodium hydroxide solution removed was 31.5% by weight, the brine concentration in the drain 210 g/l and the temperature of the draining electrolyte 88-90° C.

The electrolysis voltage at 4 kA/m$^2$ was 2.1 V. The shutdown period did not cause any deterioration in the performance of the electrolysis unit.

Example 3

The electrolysis unit from Example 2 was operated for 150 days. Within this period, the electrolysis unit was put out of operation 11 times according to the conditions in Example 2 and put back into operation correspondingly each time. The shutdown period was between 4 and 48 h in 10 shutdown periods, and 140 h in one shutdown period. During the long shutdown period, the cathode and anode spaces, after emptying, were sealed tight from air, such that no residual moisture could escape.

After 150 days, some elements of the electrolysis cell were put out of operation according to the conditions in Example 2 and then opened. On visual examination, no solid precipitates, deposits, damage to the membrane or corrosion damage to the OCE or the cathode was evident.

Example 4

In a laboratory cell, the influence of a different chloride content in the sodium hydroxide solution on the performance of the oxygen-consuming cathode was studied (composition as in Example 1). The laboratory cell had an OCE area, membrane area and anode area of in each case 100 cm$^2$. The anode (coated titanium anode like example 1) was contacted with a sufficient amount of brine that the brine draining out of the cell had a concentration of 210 g/l and a temperature of 90° C. The concentration of the sodium hydroxide solution draining out of the cell was 32% by weight and the sodium hydroxide solution had a temperature of 90° C. The alkali gap between membrane (type as in Example 1) and OCE was 3 mm. The alkali was pumped through the gap from the bottom upwards. The experimental conditions were chosen such that the chloride content in the draining alkali, as shown in the results table, was attained. The current density at which the cell voltage was determined was 4 kA/m$^2$.

RESULTS

| Chloride content | Cell voltage |
|---|---|
| 1000 ppm | 2.43 V |
| 500 ppm | 2.38 V |
| 250 ppm | 2.26 V |
| 10 ppm | 2.27 V |

At 1000 ppm of chloride, a noticeable loss of performance is observed, but no loss of performance below 250 ppm.

The invention claimed is:

1. Process for chloralkali electrolysis with an electrolysis cell having an oxygen-consuming electrode, operated according to the finite gap arrangement, the electrolysis cell having at least one anode space with an anode and an anolyte comprising alkali metal chloride, an ion exchange membrane, a cathode space with an oxygen-consuming electrode as the cathode, comprising a silver-containing catalyst, and an electrolyte gap between oxygen-consuming electrode and membrane through which a catholyte having a content of alkali metal hydroxide of 7.5-10.5 mol/l flows, wherein the catholyte is circulated and application of electrolysis voltage between anode and cathode is preceded by adjustment of the volume flow rate and/or composition of the catholyte supplied to the gap to result in an aqueous solution of alkali metal hydroxide leaving the cathode gap having a content of chloride ions of at most 1000 ppm and the electrolysis voltage is applied after introduction of the anolyte and of an oxygenous gas into the cathode space.

2. Process according to claim 1, wherein the electrolysis cell is a falling-film cell.

3. Process according to claim 1, wherein the alkali metal hydroxide solution introduced in the catholyte feed prior to application of the electrolysis voltage has a content of alkali metal chlorate of at most 20 ppm.

4. Process according to claim 1, wherein less than 240 minutes between commencement of the introduction of the catholyte and the application of the electrolysis voltage.

5. Process according to claim 1, wherein a temperature difference between anolyte feed and catholyte drain of less than 20° C. is established after commencement of the introduction of the catholyte and anolyte.

6. Process according to claim 1, wherein the alkali metal chloride is sodium chloride or potassium chloride.

7. Process for chloralkali electrolysis with an electrolysis cell having an oxygen-consuming electrode, the cell having at least one anode space with an anode and an anolyte comprising alkali metal chloride, an ion exchange membrane, a cathode space with an oxygen-consuming electrode with a silver-containing catalyst, and an electrolyte gap between oxygen-consuming electrode and membrane through which the catholyte flows, wherein chlorine is produced in the anode space during the electrolysis and at the end of the electrolysis operation, after the electrolysis voltage has been switched off, in a first step, the concentration of the alkali metal chloride solution removed from the anode space increases, then the anode space is flushed with fresh alkali metal chloride solution until the chlorine content of oxidation state 0 or greater than 0 in the anolyte is less than 10 ppm, then the anolyte temperature is lowered and then the anolyte is released from the anode space and, in a subsequent step, the introduction of the catholyte is ended and the catholyte is released from the electrolyte gap.

8. Process according to claim 7, wherein the draining anolyte has an alkali metal chloride content of 2.2 to 4.8 mol/I.

9. Process according to claim 7, wherein the electrolysis cell is a falling-film electrolysis cell.

10. Process according to claim 7, wherein the electrolysis voltage is switched off after attainment of a chlorine content in the anolyte of <10 mg/I.

11. Process according to claim 7, wherein that a positive pressure relative to the anode space of >10 mbar is maintained until the end of the emptying and flushing in the cathode space.

12. Process according to claim 7, wherein, after shutdown and emptying of the electrolysis cell, the anode space is flushed repeatedly every 1 to 12 weeks with a dilute alkali metal chloride solution having an alkali metal chloride content of 2.2 to 4.8 mol/I, and the cathode space is flushed with an alkali metal hydroxide solution having an alkali metal chloride content of 4 to 10 mol/I.

13. Process according to claim 7, wherein the alkali metal chloride is sodium chloride or potassium chloride.

* * * * *